US008857301B2

(12) United States Patent
Clark et al.

(10) Patent No.: US 8,857,301 B2
(45) Date of Patent: Oct. 14, 2014

(54) BLADE CLEARANCE GROOVE FOR CUTTING PLOTTER

(75) Inventors: Robert A. Clark, Williamson, NY (US); William J. Nowak, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 248 days.

(21) Appl. No.: 13/443,978

(22) Filed: Apr. 11, 2012

(65) Prior Publication Data

US 2013/0269495 A1 Oct. 17, 2013

(51) Int. Cl.
*B26D 5/00* (2006.01)
*B26D 7/20* (2006.01)

(52) U.S. Cl.
USPC ..... 83/76.6; 83/614

(58) Field of Classification Search
USPC ..... 83/76.6, 76.8, 76.9, 614
See application file for complete search history.

(56) References Cited

U.S. PATENT DOCUMENTS

| | | | | |
|---|---|---|---|---|
| 3,407,498 | A | 10/1968 | Young | |
| 4,042,939 | A | 8/1977 | Lloyd et al. | |
| 4,199,863 | A | 4/1980 | Deckert | |
| 4,732,069 | A | 3/1988 | Wood et al. | |
| 4,920,495 | A | 4/1990 | Pilkington | |
| 4,995,287 | A | 2/1991 | Nasu | |
| 4,996,651 | A | 2/1991 | Wells | |
| 5,011,093 | A | 4/1991 | Mayer et al. | |
| 5,060,880 | A | 10/1991 | Mayer | |
| 5,069,097 | A * | 12/1991 | Mori | 83/56 |
| 5,146,823 | A * | 9/1992 | Holmes | 83/56 |
| 5,188,009 | A | 2/1993 | Sunohara et al. | |
| 5,264,904 | A | 11/1993 | Audi et al. | |
| 5,275,077 | A | 1/1994 | Kobayashi | |
| 5,294,069 | A | 3/1994 | Blahnik | |
| 5,321,892 | A | 6/1994 | Sasada | |
| 5,443,194 | A | 8/1995 | Takahashi | |
| 5,671,647 | A | 9/1997 | Mori | |
| 5,861,077 | A | 1/1999 | Kamijo et al. | |
| 5,937,725 | A | 8/1999 | Kamijo et al. | |
| 6,112,630 | A | 9/2000 | Miura | |
| 6,189,414 | B1 | 2/2001 | Yoshizawa et al. | |
| 6,302,602 | B1 * | 10/2001 | Kiyohara et al. | 400/593 |
| 6,616,360 | B2 | 9/2003 | Lehmkuhl | |
| 6,664,995 | B2 | 12/2003 | Milton et al. | |
| 6,694,628 | B2 | 2/2004 | Kojima et al. | |
| 6,814,517 | B2 | 11/2004 | Fisher et al. | |
| 6,926,400 | B2 | 8/2005 | Kelley | |
| 6,945,645 | B2 | 9/2005 | Baron | |

(Continued)

OTHER PUBLICATIONS

U.S. Appl. No. 13/442,268, filed Apr. 9, 2012, Hoover et al.

(Continued)

*Primary Examiner* — Stephen Choi
(74) *Attorney, Agent, or Firm* — Gibb & Riley, LLC

(57) ABSTRACT

Disclosed is a cutting plotter with a feed roller that draws a sheet of media in a Y-direction while shifting the sheet back and forth along the Y-direction in response to a cutting order. The cutting plotter includes a cutting device that reciprocates in an X-direction and cooperates with the feed roller to cut the sheet in a desired shape in response to the cutting order. A base plate is disposed below the cutting device in the X-direction. The base plate has a channel formed in it. The channel is sized and configured to receive a portion of a blade of the cutting device when the blade engages the sheet and the blade traverses laterally along the channel.

11 Claims, 5 Drawing Sheets

(56) References Cited

U.S. PATENT DOCUMENTS

| | | | |
|---|---|---|---|
| 7,789,484 | B2 | 9/2010 | Takada et al. |
| 7,930,958 | B2 | 4/2011 | Workman et al. |
| 2003/0230843 | A1 | 12/2003 | Clark |
| 2005/0268469 | A1 | 12/2005 | Fritz |
| 2006/0090621 | A1 | 5/2006 | Shimizu |
| 2007/0261529 | A1 | 11/2007 | Schulz |
| 2010/0058943 | A1 | 3/2010 | Bober |
| 2011/0148994 | A1 | 6/2011 | Lin et al. |
| 2011/0152048 | A1 | 6/2011 | Gombert |
| 2011/0283849 | A1 | 11/2011 | Takizawa |

OTHER PUBLICATIONS

U.S. Appl. No. 13/194,372, filed Jul. 29, 2011, DuFort.
U.S. Appl. No. 13/439,369, filed Apr. 4, 2012, Nowak et al.

* cited by examiner

BLADE CLEARANCE GROOVE FOR CUTTING PLOTTER

BACKGROUND

Embodiments herein generally relate to cutting plotters, and in particular to a plate that can be installed in a cutting plotter to extend the life of the cutting blade.

A cutting plotter, sometimes referred to in the commercial world as a digital vinyl cutter, is similar to a pen plotter, with the exception that a cutting blade is used instead of a pen. A sheet of media, such as vinyl, paper or other material, is moved back and forth in the process direction by a knurled roll/idler roll combination. Movement in the cross process direction is accomplished by moving the cutting blade via a carriage. Backing on the opposite side of the sheet from the cutting blade is typically a polytetrafluoroethylene or PTFE (sold commonly under the tradename Teflon® and is available from DuPont Co., Wilmington, Del., USA) strip or other soft sacrificial material on top of a flat sheet-metal cutting surface. The purpose of the Teflon® strip is to offer a relatively soft sacrificial surface for the cutting blade to enter when the cutting blade cuts completely through the media. Without that sacrificial Teflon® layer, the cutting blade would contact the sheet metal cutting surface when cutting all the way through the media, thereby damaging or at least dulling and reducing the life of the cutting blade. The Teflon® strip abrades with use and needs to be replaced quite frequently. One solution to this problem is to temporarily attach a plastic backing sheet to the media that will be cut. However, this is a time consuming process, requires some skill on the part of the operator, and would add additional material for the cutting knife to come in contact with causing additional loss of cutting knife life. In addition, a plastic backing sheet would also seriously compromise the auto feeding capability of the digital cutter.

SUMMARY

In view of the foregoing, disclosed herein are embodiments that propose introducing a recess groove to relieve the pressure point beneath a linear cutter head. This 'relief groove' permits the blade to only contact the media being cut, which lengthens the life of the cutting blade, and assures precision cuts over the lifetime of the cutter, resulting in no wear of the cutting surface. Systems and methods herein provide the opportunity to lengthen the life of the cutting blade, reducing downtime, and reducing misregistration of the cutter (due to reduced change out time and chance for error).

According to an embodiment herein a cutting plotter is disclosed. The cutting plotter comprises a feed roller that draws a sheet of media in a Y-direction while shifting the sheet back and forth along the Y-direction in response to a cutting order. The cutting plotter includes a cutting device that reciprocates in an X-direction and cooperates with the feed roller to cut the sheet in a desired shape in response to the cutting order. A base plate is disposed below the cutting device in the X-direction. The base plate has a plurality of channels formed in it. Each channel is sized and configured to receive a portion of a blade of the cutting device when the blade engages the sheet.

According to another embodiment herein, a material cutting assembly is disclosed. The cutting assembly comprises a cutting head. A solenoid and spring are mounted in the cutting head. A cutting tool is detachably fixed to the solenoid. The cutting tool has a sharp point disposed on a tip thereof and is movable between an engaged position when the solenoid is energized to extend the cutting tool and a non-engaged position when the solenoid is de-energized and the spring retracts the cutting tool. An elongated base plate is disposed below the cutting tool. The base plate has a plurality of channels formed in it. Each channel is sized and configured to receive the point of the cutting tool when the cutting tool is in the engaged position.

According to another embodiment herein, a device for incising a sheet of media is disclosed. The device comprises a chassis, a motor, and a carriage operably secured to the chassis and driven by the motor for reciprocal movement relative to the chassis. A cutting device is operably secured to the carriage. The cutting device includes a mechanical incising structure movable between an engaged position wherein the incising structure operably engages the sheet of media and a non-engaged position wherein the incising structure does not engage the sheet of media. An elongated base plate is disposed below the carriage. The base plate has a plurality of channels formed in it. Each channel is sized and configured to receive a portion of a blade of the mechanical incising structure when the mechanical incising structure is in the engaged position.

These and other features are described in, or are apparent from, the following detailed description.

BRIEF DESCRIPTION OF THE DRAWINGS

Various exemplary embodiments of the systems and methods are described in detail below, with reference to the attached drawing figures, in which.

DETAILED DESCRIPTION

Figure 1:
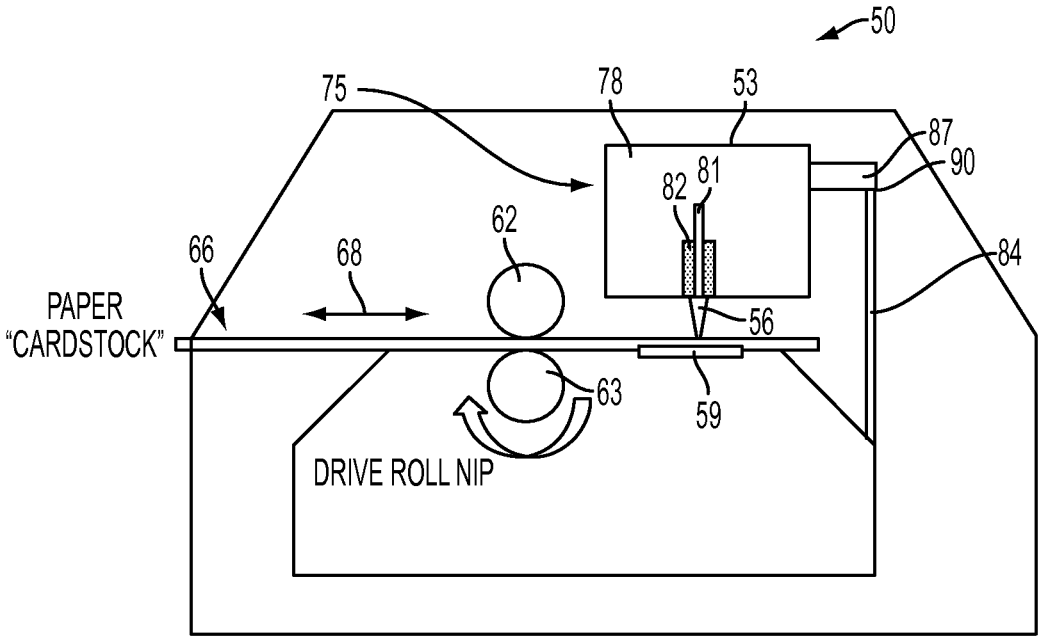
FIG. 1 is a cross-sectional schematic diagram of a cutter according to embodiments herein.

Recently, there has been an effort to develop an auto-feed media cutter to enable profitable production of small volumes of media structures such as boxes. Typically, boxes are cut from sheets using relatively expensive die-cutting equipment. This cost inhibits the ability to accommodate small orders. However, there are less expensive, commercially available media cutters. The design of these cutters is similar to pen plotters that were in wide use in the 1980s, except that these cutting plotters use a blade instead of a pen. This type of cutting plotter typically use a knurled or partially knurled shaft & idlers to maintain control of the sheet and move it back and forth in the process direction during a cut job. The other axis is accommodated via a belt or cable driven carriage upon which a blade assembly is mounted. The knife blade assembly includes a solenoid-based mechanism that lowers the blade against the sheet when a cut is to be made. A return spring lifts the blade away from the sheet once the solenoid is de-energized. The control of both axes and the solenoid is dictated by a cut file which is generated by a computer application and downloaded to the cutting plotter.

What is also typical of the vinyl cutter products cutters is a sacrificial cutting surface that lies underneath the paper all along the path where the knife blade traverses. When the traveling knife blade completely penetrates the paper for a "cut", the blade continues down into the sacrificial layer which is typically a soft plastic type material. This layer is sometimes as simple as a "Teflon-like" tape, or a soft plastic piece embedded in the cutting surface structure which is typically sheet metal or some other structural material. The sacrificial layer must be replaced periodically.

In addition to a sacrificial layer, some plotter manufacturing companies recommend the use of an adhesive backing sheet to further help protect the cutting surface from the blade. A user presses the sheet to be cut onto a backing sheet, locates the sheet within the cutting plotter, and then executes the cut file. After the print sheet is cut, the backing sheet is peeled away. While this process works, the backing sheet quickly loses its adhesiveness, and needs to be replaced frequently. Furthermore, in order to enable the cut volume that auto-feed capability provides, typically users will simply cut against the Teflon® tape that covers the cutting surface. While this greatly facilitates the cutting of multiple sheets, over time the tip of the blade scratches a groove into the Teflon® tape. This eventually results in uneven cutting of the sheet, requiring that the tape be replaced. Moreover, if the blade penetrates too far down into the sacrificial surface, the cutting blade could come in contact with the less forgiving structure below the sacrificial layer and more rapidly dull or even permanently break the blade, necessitating immediate replacement.

Regardless of cutting with or without a backing sheet or with any high-tech plastic material used in the sacrificial cutting surface, any physical contact of the cutting blade with anything other than the paper significantly decreases the life of the blade, resulting in expensive and frequent replacement.

Referring to the drawings, embodiments herein provide a base plate with a plurality of recess grooves to relieve the pressure point beneath a linear cutter head. The 'relief groove' permits the cutting blade to only contact the media being cut. The cutting base plate incorporates a groove that provides clearance between the blade tip and the cutting base plate material. The length of the groove is greater than or equal to the cross-process direction of travel of the blade carriage, with the width of the groove being sufficient to provide adequate clearance between the blade tip and the cutting base plate. The cutting base plate can be fabricated from a material that will last the life of the cutting plotter, thereby eliminating the need for backing sheets or Teflon® strips. This reduces the running cost of the cutter and improves operability. With this clearance or grove on the cutting surface, blade life is maximized since the only source of abrasion to the cutting blade will be the media that it is cutting.

FIG. 1 shows a cross-sectional view of a cutter plotter, indicated generally as 50. The cutter plotter 50 includes a cutting mechanism 53 having a cutting blade 56. A base plate 59 is disposed beneath the cutting mechanism 53. Feed rollers 62, 63 engage and draw a sheet of media 66, such as paper or cardstock, in a Y-direction (sometimes referred to as the "process direction") into the cutter plotter 50. The rollers 62, 63 shift the sheet 66 back and forth along the Y-direction, as indicated by arrow 68, in response to a cutting order from a controller. The cutting mechanism 53 reciprocates in an X-direction (sometimes referred to as the "cross-process direction"), perpendicular to the direction indicated by the arrow 68, and cooperates with the feed rollers 62, 63 to cut the sheet 66 in a desired shape in response to the cutting order. Thus, while the sheet 66 is fed in the Y-direction in response to a series of cutting orders, the cutting mechanism 53 is shifted back and forth along the X-direction under a state where the cutting blade 56 is brought down, so desired figures may be obtained by means of the cutting cutter plotter 50.

Figure 2:
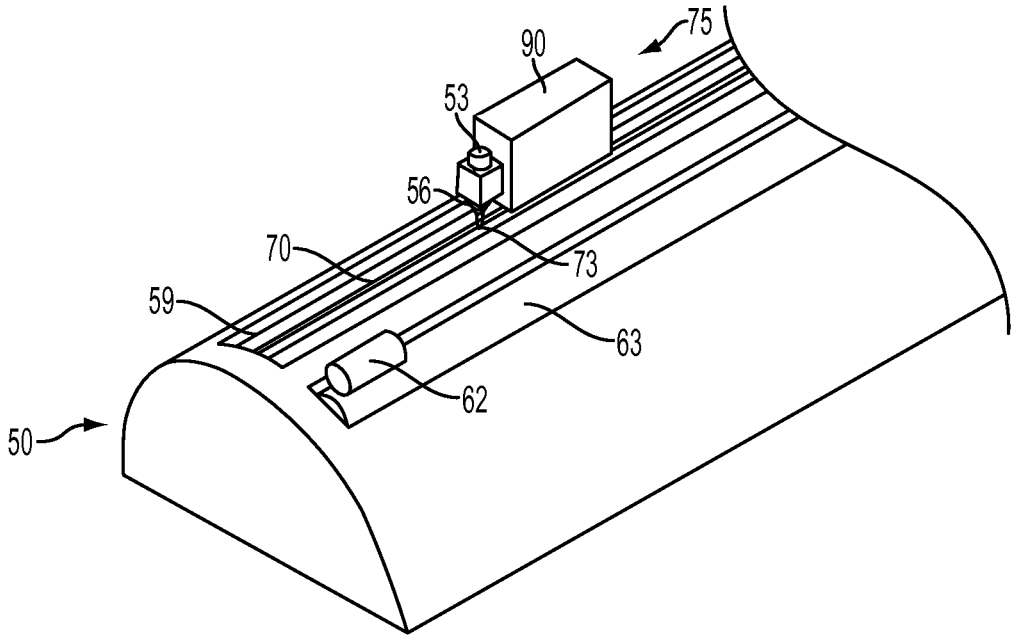
FIG. 2 is a perspective view of a cutter according to embodiments herein.

As shown in FIG. 2, the base plate 59 is disposed below the cutting mechanism 53 in the X-direction. The base plate 59 has a channel 70 formed in it. The channel 70 is sized and configured to receive a portion of the cutting blade 56 of the cutting mechanism 53 when the cutting blade 56 engages the sheet 66 and the blade 56 traverses along the length of the channel 70. That is, the base plate 59 is stationary and the blade 56 moves relative to the channel 70 in the plane of the media sheet 66.

The base plate 59 incorporates a channel 70 that provides clearance between the tip 73 of the cutting blade 56 and the base plate 59. In some embodiments, a user can position the base plate 59 to select an appropriate shape of the channel 70 for the type of material being cut, see FIG. 3. In some instances, it may be desirable to have a preferred shape of the channel 70 for particular materials being cut. According to embodiments herein, the cutting base plate 59 can be removable to enable a plate with different groove geometry to be exchanged as desired or required. FIG. 4 illustrates several non-limiting examples of groove shapes for channel 70. The length of the channel is greater than or equal to the cross-process direction travel of the cutting blade carriage, with the width of the channel 70 being sufficient to provide adequate clearance between the tip 73 of the cutting blade 56 and the base plate 59.

The cutting base plate 59 can be fabricated from a material that will last the life of the cutter plotter 50.

In accordance with embodiments herein, a cutting assembly 75 comprises cutting head 78. A solenoid 81 and spring 82 are mounted in the cutting head 78. A cutting blade 56 is detachably fixed to the solenoid 81. The cutting blade 56 has a sharp point at the tip 73 and is movable between an engaged position and a non-engaged position. The cutting blade 56 engages the sheet 66 when the solenoid 81 is energized to extend the cutting blade 56. The cutting blade 56 disengages when the solenoid 81 is de-energized and the spring 82 retracts the cutting blade 56 from the sheet 66. The elongated base plate 59 is disposed below the cutting assembly 75. The base plate 59 incorporates the channel 70 that provides clearance between the tip 73 of the cutting blade 56 and the cutting base plate 59.

In accordance with embodiments herein, the cutting assembly 75 comprises a chassis 84, a motor 87, and a carriage 90 operably secured to the chassis 84 and driven by the motor 87 for reciprocal movement relative to the chassis 84. Typically, the cutter cutting assembly 75 is moved back and forth in the X-direction via a capstan-type drive, the motor of which may be hidden in the cutter plotter 50. The cutting blade 56 is operably secured to the carriage 90.

Thus, as shown above, in order to provide a durable cutting surface that will not damage the blade and extend blade life, the cutting area of the plotter can be modified to incorporate a grooved plate. The groove provides clearance for the blade tip as it protrudes through the media being cut. One feature of this structure is that a grooved bar is inexpensive and will last the life of the cutter. Another feature is that a grooved plate allows a greater tolerance with respect to setting the blade cutting depth. When either a backing sheet or sacrificial cutting surface is used, the blade depth must be precisely set to minimize damage to the sacrificial cutting surface or the backing sheet. Thus, a blade depth setup is required whenever media with a different basis weight is used. In contrast, the grooved plate disclosed herein allows some over-penetration, which in turn substantially reduces the need for blade depth setups when switching from one media to another. Additionally, the systems described herein allow the user to select a preferred shape of the channel for particular media to be cut.

Figure 3:
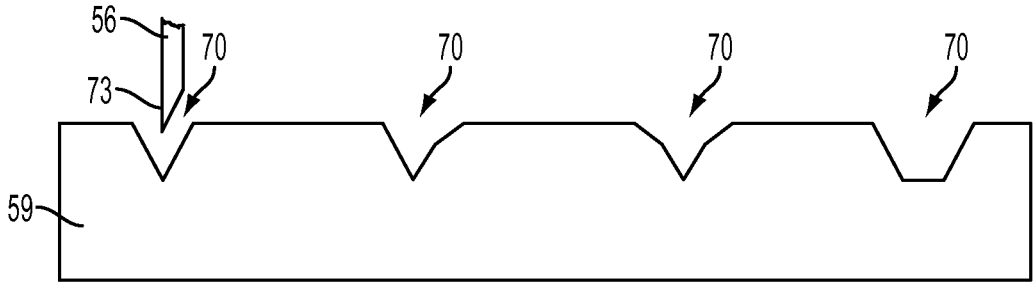
FIG. 3 is an end view of a base plate according to embodiments herein.
Figure 4:
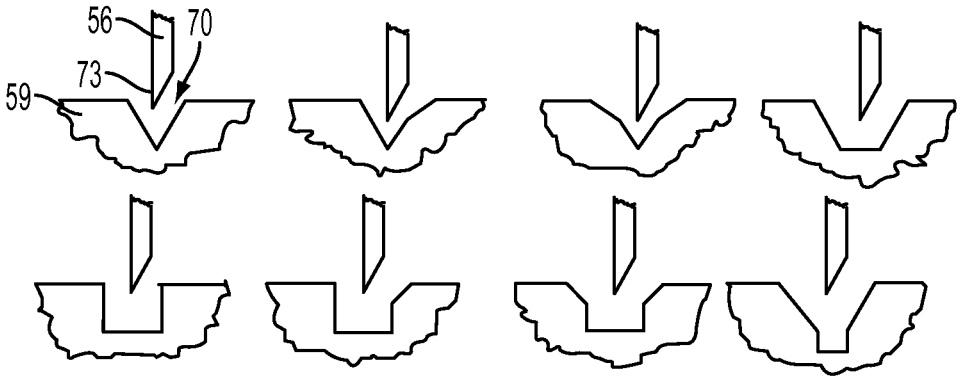
FIG. 4 is a cut-away end view of exemplary groove alternatives according to embodiments herein.

In some embodiments, the base plate includes a plurality of channels from which a preferred shape can be selected, such as shown in FIG. 3. The base plate can be adjusted to align the selected channel under the cutting assembly. Furthermore, according to embodiments herein, the cutting base plate is removable to enable a user to exchange the base plate with a plate having different groove geometry, as desired or required.

FIG. 4 shows a cut-away end view of a portion of a grooved base plate 59 and shows some possible groove cross-section shapes that may be desirable. The shape of the channel 70 may correspond to any geometry, although the width of the channel 70 should be sufficient to provide adequate clearance between the tip 73 of the cutting blade 56 and the cutting base plate 59. It has been found that the wider channel 70 works better, as it is more robust against misalignment of the cutting blade 56 versus the channel 70, due to cutter tolerance stack-up. The examples shown in FIG. 4 are for illustration only and are not intended to be limiting on the various geometries that can be used according to embodiments herein. Different materials can also be used for the base plate 59, such as aluminum, steel, plastic, and high density urethane commonly found on cutting boards.

According to embodiments herein, the base plate 59 may be mounted on a cylinder having a plurality of shaped channels around the periphery of the cylinder, such that a user rotates the cylinder to align the selected channel under the cutting assembly.

Figure 5:
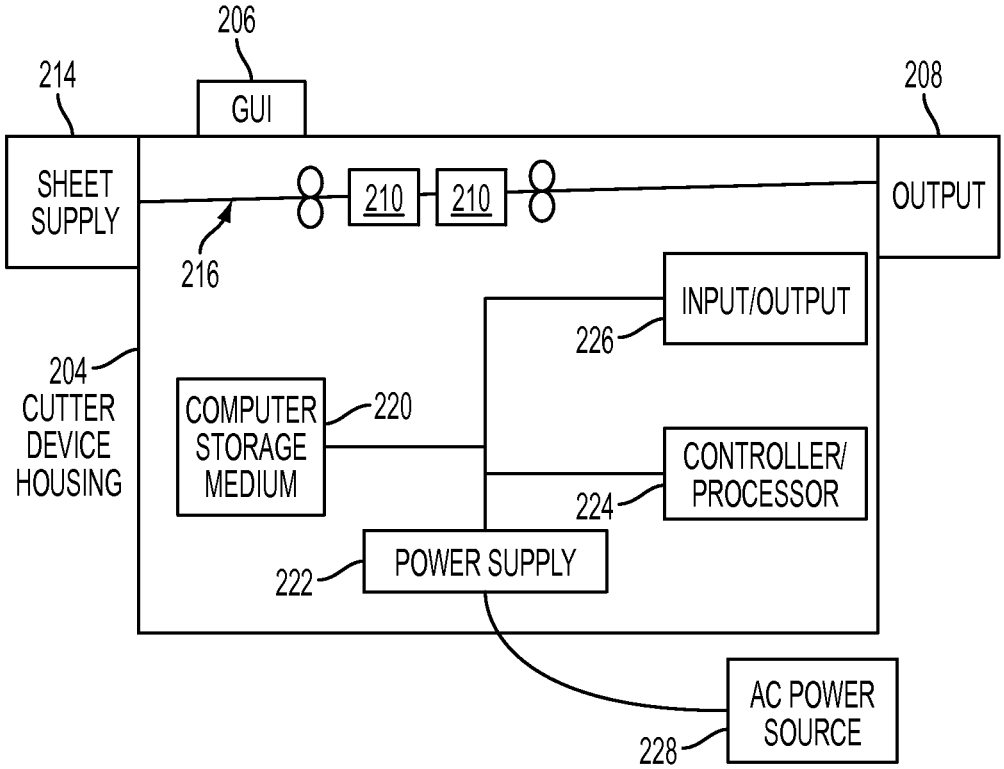
FIG. 5 is a cross-sectional schematic diagram of a cutting device according to embodiments herein.

FIG. 5 illustrates a cutting device 204 that can be used with embodiments herein. The cutting device 204 includes a controller/processor 224 and a communications port (input/output) 226 operatively connected to the processor 224 and to a computerized network external to the cutting device 204. Also, the cutting device 204 can include at least one accessory functional component, such as a graphic user interface assembly 206 that also operate on the power supplied from the external power source 228 (through the power supply 222).

The cutting device 204 includes at least one cutting device (cutting engines) 210 operatively connected to the processor 224, a media path 216 positioned to supply sheets of media from a sheet supply 214 to the cutting device(s) 210, etc. After receiving various cuttings from the cutting engine(s), the sheets of media can optionally pass to an output 208 which can stack, sort, etc., the various cut sheets.

The input/output device 226 is used for communications to and from the cutting device 204. The processor 224 controls the various actions of the cutting device. A non-transitory computer storage medium device 220 (which can be optical, magnetic, capacitor based, etc.) is readable by the processor 224 and stores instructions that the processor 224 executes to allow the cutting device to perform its various functions, such as those described herein. Thus, as shown in FIG. 5, a body housing 204 has one or more functional components that operate on power supplied from the alternating current (AC) 228 by the power supply 222. The power supply 222 can comprise a power storage element (e.g., a battery) and connects to an external alternating current power source 228 and converts the external power into the type of power needed by the various components.

It should be understood that the term "controller" as used herein comprises a computerized device adapted to perform (i.e., programmed to perform, configured to perform, etc.) the above described system operations (e.g., controlling roller movement, controlling roller rotation, etc.). Preferably this controller comprises a programmable, self-contained, dedicated mini-computer having a central processor unit (CPU), electronic storage, and a display or user interface (UI) and can function as the main control system for either a stand-alone document production system or multiple modules (e.g., the feeder module(s), stacker module(s), interface modules(s) printing module(s), cleaning modules, binding modules, etc.) within a modular document production system. Computerized devices that include chip-based central processing units (CPU's), input/output devices (including graphic user interfaces (GUI), memories, comparators, processors, etc. are well-known and readily available devices produced by manufacturers such as Dell Computers, Round Rock Tex., USA and Apple Computer Co., Cupertino Calif., USA. Such computerized devices commonly include input/output devices, power supplies, processors, electronic storage memories, wiring, etc., the details of which are omitted herefrom to allow the reader to focus on the salient aspects of the embodiments described herein. Similarly, scanners and other similar peripheral equipment are available from Xerox Corporation, Norwalk, Conn., USA and the details of such devices are not discussed herein for purposes of brevity and reader focus.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. The claims can encompass embodiments in hardware, software, and/or a combination thereof. Unless specifically defined in a specific claim itself, steps or components of the embodiments herein should not be implied or imported from any above example as limitations to any particular order, number, position, size, shape, angle, color, or material.

Therefore, disclosed above are embodiments of a device for incising a sheet of media. The device comprises a chassis, a motor, and a carriage operably secured to the chassis and driven by the motor for reciprocal movement relative to the chassis. A cutting device is operably secured to the carriage. The cutting device includes a mechanical incising structure movable between an engaged position wherein the incising structure operably engages the sheet of media and a non-engaged position wherein the incising structure does not engage the sheet of media. An elongated base plate is disposed below the carriage. The base plate has a channel formed in it. The channel is sized and configured to receive a portion of a blade of the mechanical incising structure when the mechanical incising structure is in the engaged position.

What is claimed is:

1. A cutting plotter, comprising:

a feed roller that draws a sheet of media in a Y-direction while shifting said sheet back and forth along said Y-direction in response to a series of cutting orders;

a cutting device that reciprocates in an X-direction in response to said series of cutting orders, said cutting device having a sharp point that can be raised and lowered and cooperates with said feed roller to cut said sheet in a desired shape while said sheet is fed in response to said series of cutting orders, said sharp point of said cutting device being moveable between an engaged position below said sheet and a non-engaged position above said sheet, enabling cuts of said desired shape in said sheet corresponding to said series of cutting orders; and a base plate disposed below said cutting device in said X-direction, said base plate disposed below said cutting device being removable and having a plurality of channels, each channel of said plurality of channels having a length greater than or equal to a cross-process direction of travel of said cutting device, each of said at least one channel being sized and configured to receive a portion of said sharp point of said cutting device when said sharp point engages said sheet in response to said series of cutting orders, said channel providing clearance so there is no contact between said sharp point and said base plate while cuts are made to said sheet in response to said series of cutting orders, wherein at least one channel of said plurality of channels having a channel geometry that is different from the channel geometry of others of said plurality of channels said sharp point being movable laterally along a portion of said at least one channel.

2. The cutting plotter according to claim 1, said base plate comprising aluminum, steel, plastic, or high density urethane.

3. A material cutting assembly, comprising:

a cutting head, comprising:

a solenoid and spring mounted in said cutting head; and a cutting tool detachably fixed to said solenoid and having a sharp point disposed on a tip thereof, said cutting tool being movable between an engaged position when said solenoid is energized to extend said sharp point below a sheet of media positioned for cutting and a non-engaged position when said solenoid is de-energized and said spring retracts said sharp point above said sheet of media, enabling cuts of a desired shape in said sheet of media; and an elongated base plate disposed below said cutting tool, said elongated base plate disposed below said cutting tool being removable and having a plurality of channels, each channel of said plurality of channels having a length greater than or equal to a cross-process direction of travel of said cutting device, each of said at least one channel being sized and configured to receive said sharp point of said cutting tool when said cutting tool is in said engaged position, said channel providing clearance so there is no contact between said sharp point and said base plate while cuts are made to said sheet of media, wherein at least one channel of said plurality of channels having a channel geometry that is different from the channel geometry of others of said plurality of channels said cutting tool being movable laterally along a portion of said channel.

4. The material cutting assembly according to claim 3, further comprising a carriage connected to a chassis for reciprocal movement relative to said chassis, said cutting head being attached to said carriage.

5. The material cutting assembly according to claim 4, further comprising a feed roller that draws said sheet of media into a cutting plotter while shifting said sheet of media back and forth in response to cutting orders, said feed roller cooperating with said carriage to cut said sheet in said desired shape in response to said cutting orders.

6. The material cutting assembly according to claim 3, each channel of said plurality of channels providing clearance between said tip of said cutting tool and said base plate.

7. The material cutting assembly according to claim 3, said base plate comprising aluminum, steel, plastic, or high density urethane.

8. A device for incising a sheet of media, comprising:

a chassis;

a motor;

a carriage connected to said chassis and driven by said motor for reciprocal movement relative to said chassis;

a cutting device connected to said carriage, said cutting device including a mechanical incising structure having a sharp point that can be raised and lowered, moving said mechanical incising structure between an engaged position wherein said incising structure engages said sheet of media in which said sharp point is below said sheet and a non-engaged position wherein said incising structure does not engage said sheet of media in which said sharp point is above said sheet; and an elongated base plate disposed below said carriage, said elongated base plate disposed below said cutting device being removable and having a plurality of channels, each channel of said plurality of channels having a length greater than or equal to a cross-process direction of travel of said cutting device, each of said at least one channel being sized and configured to receive a portion of said sharp point of said mechanical incising structure when said mechanical incising structure is in said engaged position, said channel providing clearance so there is no contact between said sharp point and said base plate while cuts are made to said sheet of media, wherein at least one channel of said plurality of channels having a channel geometry that is different from the channel geometry of others of said plurality of channels said mechanical incising structure being movable laterally along a portion of said channel.

9. The device according to claim 8, said cutting device further comprising a solenoid and spring mounted in said cutting device, said mechanical incising structure being detachably fixed to said solenoid, said mechanical incising structure moving to said engaged position when said solenoid is energized to extend said mechanical incising structure, and said mechanical incising structure moving to said non-engaged position when said solenoid is de-energized and said spring retracts said mechanical incising structure.

10. The device according to claim 8, further comprising a feed roller that draws a sheet of media into said device while shifting said sheet back and forth in response to cutting orders, said feed roller cooperating with said carriage to cut said sheet in a desired shape in response to said cutting orders.

11. The device according to claim 8, said base plate comprising aluminum, steel, plastic, or high density urethane.

* * * * *